US005269374A

United States Patent [19]

Taylor

[11] Patent Number: 5,269,374

[45] Date of Patent: Dec. 14, 1993

[54] LOCATOR METHOD AND APPARATUS

[76] Inventor: William T. Taylor, 1412 Cottage Dr., Houma, La. 70360

[21] Appl. No.: 809,731

[22] Filed: Dec. 17, 1991

[51] Int. Cl.[5] ..... E21B 47/08

[52] U.S. Cl. ..... 166/255; 166/113; 166/117.5

[58] Field of Search ..... 166/64, 255, 51, 55, 166/113, 178, 117.5, 297, 100; 411/517, 518

[56] References Cited

U.S. PATENT DOCUMENTS

| | | | |
|---|---|---|---|
| 2,340,861 | 2/1944 | Breukelman | 166/255 |
| 2,350,832 | 6/1944 | Segesman | 166/255 |
| 2,999,542 | 9/1961 | Myers | 166/255 |
| 3,695,368 | 10/1972 | Lanmon, II | 175/4.52 |
| 3,696,865 | 10/1972 | Chapman | 166/255 |
| 3,888,306 | 6/1975 | Wetzel | 166/255 |
| 3,997,003 | 12/1976 | Adkins | 166/255 |
| 4,450,539 | 5/1984 | Bright | 166/255 |
| 5,036,916 | 8/1991 | Bennett | 166/64 |
| 5,113,703 | 5/1992 | Hearn | 166/255 |

*Primary Examiner*—Thuy M. Bui
*Assistant Examiner*—Frank S. Tsay
*Attorney, Agent, or Firm*—Matthews and Associates

[57] ABSTRACT

This invention relates to the method and apparatus for locating and indicating collars and tubing ends through the use of a locator capable of repetitive use in a number of runs downhole in any given tubing situation. Specifically, this invention relates to a series of compressive springs and bows protruding radially outward from the locator and coming into contact with the inner bore of the tubing, thereby indicating upon contact with the collar or tubing end when run downhole. Therefore, this invention relates to a new and improved tubing end locator capable of running a number of times downhole to locate collars and tubing ends without the necessity of removal of the tubing end locator uphole and re-working or re-tooling. Alternatively, this locator may be used as a centralizer to center any object within the tubing that is connected to the locator.

9 Claims, 1 Drawing Sheet

LOCATOR METHOD AND APPARATUS

A tubing end locator is commonly used downhole in wellbore casing or tubing for locating any depth and/or pipe joint in a tubing string. The present invention departs from conventional methods and apparatus by use of high compressive springs and a set of "bow springs" positioned between the high compressive springs that protrude radially from the locator mandril and contact the internal portion of the tubing. Conventional tubing end locators implement calipers, clips or fingers which extend vertically upward and outwardly from the tubing end locator such that each calliper or finger is spring loaded and exerts an external pressure against the internal diameter and circumference of the tubing. Each calliper or finger deflects at each juncture that a collar is located, thus indicating a collar or nipple is located.

When running a conventional tubing end locator downhole, the end of the tubing is indicated when the tubing end locator runs out the end of the tubing and is then brought back uphole, thus shearing the finger and indicating the depth of the tubing. Thus, tubing end locators employing calipers, fingers or other protrusions are capable of only reading the end of the tubing once, and therefore yield a low level of accuracy as to the depth of the tubing. Consequently, when a conventional tubing end locator is run downhole and brought back uphole at the tubing end, the calliper or finger is sheared completely off thus indicating the end of the tubing and destroying the calliper or finger and requiring the tubing end locator to be brought back uphole to be re-worked or re-tooled.

Thus, the tubing end locators used today do not address the problems associated with the required accuracy in finding pipe joints, collars and tubing ends downhole in wellbore casing or tubing, and the associated problems in having to re-work or re-tool each tubing end locator after each use downhole.

The preferred embodiment of the present invention combines one or more high compressive springs and a set of "bow springs" extending radially from a mandril on the locator. The "bow springs" extend vertically, longitudinally and radially outward from the mandril thus contacting the internal circumference and surface of the casing or tubing, and establishing a constant internal resistance hydraulically detected uphole at the surface. When the "bow springs" contact a pipe joint, collar or tubing end, the "bow springs" will move either upwardly towards the surface at each collar indication, or downwardly towards the end of the tubing at each tubing end indication. Each upward or downward movement of the "bow springs" will likewise trigger the compression of each upper and lower high compressive spring in order that the "bow springs" and high compressive springs may be re-used for various readings of each pipe joint, collar or tubing end location, without the need or necessity for re-working or re-tooling the locator.

Another embodiment of the present invention combines one or more of the high compressive springs and a set of "bow springs" extending radially from a mandril on the locator however, used to centralize objects connected either above or below the locator in such a way that the "bow springs" are not passed through obstructions, however constantly contact the interior walls of the tubing downhole so as to centralize and stabilize the locator and objects connected thereto.

One improvement of the present invention is the design of the high compressive springs located just above and below the "bow springs" on the mandril of the tubing end locator. The high compressive springs implement parallel slots equidistantly placed about the cylindrical body of the spring enabling it to withstand heavy compressive loads while detecting any divergence in compression along the spring's longitudinal axis. However, the high compressive springs are not limited to the foregoing embodiment and design, and may be designed in a number of ways altering the thickness of the body of the spring, placement, shape, and number of open slots, so as to accommodate varying compressive loads. A shift in weight of the locator, hydraulically read uphole, indicates that a collar or tubing end has been located due to the increase or decrease in weight of the tubing string containing the locator and a similar change in compression indicated by the springs' compression.

While the foregoing invention has been described as being a locator utilizing a plurality of high compressive springs with "bow springs" positioned therebetween, it is to be understood that the invention may be utilized in any type situation where the end of an object is unknown but needs to be located such that the movement longitudinally or radially of the locator can be used to accurately determine the location and depth of devices without physically being at the end of the device.

DETAILED DESCRIPTION OF THE DRAWINGS

Figures 1, 2, 3:
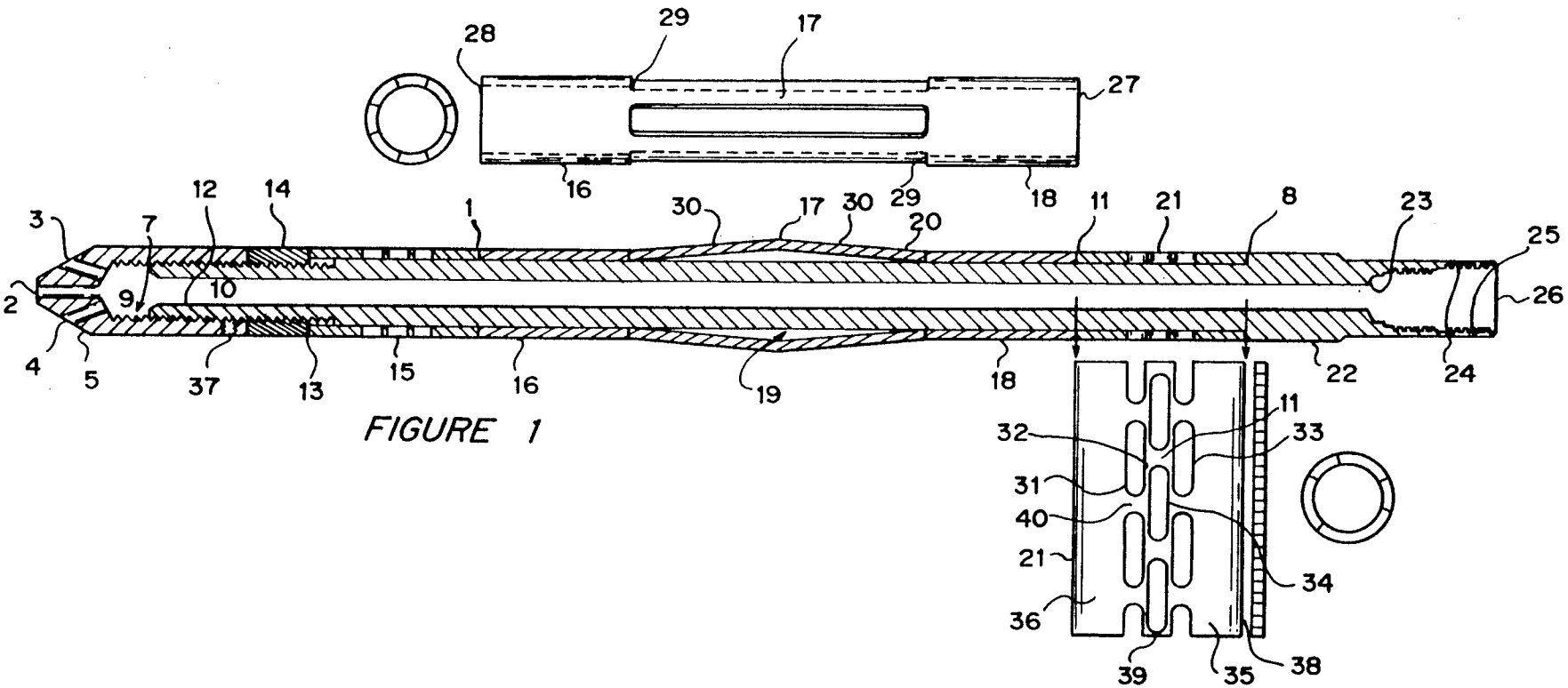
FIG. 1 is a longitudinal cross-sectional view of the locator.
FIG. 2 is a longitudinal view of the bow springs.
FIG. 3 is a plan view of number 21 of FIG. 1 representing one embodiment of the high compressive spring.

FIG. 1 depicts a jet nose cone 5 with ports 2, 3 and 4 extending horizontally and diagonally therethrough into an internal chamber 9 leading to the cylindrical longitudinal opening 10, and exiting into opening 26 at the end of the locator. Thus, the locator of FIG. 1 is capable of carrying any number of liquids or fluids and may double as a washing tool if necessary. Jet nose cone 5 is conically shaped to enable ports 2, 3 and 4 to reach every angle of the interior of the tubing and to facilitate the downward movement of the locator in the tubing when locating pipe joints, collars and tubing ends. Jet nose cone 5 is further internally threaded at 7 to connect and screw onto the upper end of mandril 12, and is securely fastened thereto by set screw 37. Additionally, jet nose cone 5 is securely fastened to the other end of mandril 12 by tension nut 14. The lower compressive spring 15, detailed in FIG. 3, is slidably mounted horizontally and longitudinally on the locator and abutting the tension nut at 13, thereby securely positioning the compressive spring 15 in sealing engagement at 13 with the tension nut 14.

At the middle of the locator is located the upper end of the bows 18 extending radially downward against the interior of the tubing (not shown). The bow springs comprise centralizer springs 30 extending downward from the upper end of bows 18 extending to their most external point 17. Thus, the bow springs 16, 17, 18 and 30 completely circumscribe the middle portion of mandril 20 and contain a variety of externally protruding outward centralizer springs 30 and 17, creating a void 19 between the centralizer springs at 17. Naturally, the bow springs contain a lower portion thereof at 16 and also abutting the upper compressive spring 21 at 11 and in sealing engagement thereto.

Another function of running the locator of FIG. 1 downhole is to hydraulically indicate the location of collars by reading, uphole, the constant compressive load on the locator (not shown). The tubing string is threadedly connected in sealing engagement at 26 to the end of mandril 22 at 24 and 25. Accordingly, once the locator of FIG. 1 is run downhole and the external portion of the centralizer spring 30 at 17 hits a collar or nipple, the weight of the tubing string will decrease as read uphole, thereby creating compression in spring 21 when the centralizer springs 30 are forced inward filling void 19 and moving the end of the bow springs 18 against the upper compressive spring 21 at 11, while forcing the compression of spring 21 against the upper portion of mandril 22, at 8.

Similarly, once the locator of FIG. 1 is run downhole and through the end of the tubing string and is pulled back uphole, the centralizer springs 30 will be forced inward through contact at 17 with the end of the tubing filling void 19 against the middle of the mandril 20, and forcing the lower bow spring 16 against spring 15 at 1; thereby, compressing spring 15 into tension nut 14 at 13, and increasing the weight of the tubing string as hydraulically read uphole.

Referring now to FIG. 2, a more detailed view of the bow springs is depicted. Again, 17 represents the most external protruding portion of the bow springs that come into contact with the internal diameter and circumference of the tubing (not shown), creating pressure at points 29 and moving, respectively, the upper portion of the bow springs 18, or the lower portion of the bow springs 16 and creating compressive loads placed on the upper spring at 27 or the lower spring at 28. This method is an improvement over the prior art in that this method and apparatus may be implemented in more than one situation and in more than one tubing without the necessity of re-working or re-tooling. Further, the ideal method of indicating a collar or tubing end involves a constant compressive load remaining constant throughout the downhole movement of the locator, and upon an indication of an increased compressive load a collar is found, and upon and indication of an increased tension load, the location of the tubing end is found.

Referring now to FIG. 3, a more detailed description of the upper compressive spring 21 and the lower compressive spring 15 is depicted, showing an upper cylindrical housing 35 terminating at 38, and a lower cylindrical housing 36 terminating at 21. Further, the middle cylindrical portion of the compressive spring 39 contains parallel slotted openings 31, 33 and 34 separately spaced at equidistant intervals 40 and 41. The unique and novel feature of this compressive spring over the prior art of record is demonstrated by the high compressive load that the compressive spring is capable of withstanding with slight deviation of deflection in the spring at 32 due to 32 is the weakest point on the spring's body because of the overlap of slotted openings 31, 33 and 34. The compression spring is capable of being read uphole as a variation in the weight of the tubing string initiated by the movement of the locator in FIG. 1 as it moves downhole, or uphole, and comes into contact with collars at the external bows 17, or likewise, when it comes into contact with tubing ends.

An alternative embodiment and use of the locator of FIG. 1 serves to centralize objects connected therebetween said locator of FIG. 1 by running the lower portion of the locator of FIG. 1 downhole such that said "bow springs" 17, 19, 20 and 30 act to centralize and stabilize said locator, and those objects connected to the end of said locator at 23, 24, 25 and 26. The locator of FIG. 1 therefore, is run downhole wherein said "bow springs" 17, 19, 20 and 30 contact the inner surfaces of said tubing, maintaining an equidistant relationship between the locator and objects connected at the end thereto (26) from the internal surface area of the tubing.

Again, the novelty of this apparatus is demonstrated by the repetitive use of the locator as it functions to locate pipe joints, collars or tubing ends without the necessity of re-working or re-tooling. The locator therefore, may be used in various operations and functions and in a number of wells.

From the foregoing it will be seen that this invention is one well adapted to obtain all the ends and objects hereinabove set forth, together with other advantages which are obvious and which are inherent to the apparatus.

It will be understood that certain features and sub-combinations are of utility and may be employed with reference to other features and sub-combinations. This is contemplated by, and is within the scope of the claims.

Since many possible embodiments may be made of the invention without departing from the scope thereof, it is understood that all matters herein set forth or shown in the accompanying drawings are to be interpreted as illustrative and in a limiting sense per view of the invention as specified in the appended claims.

What is claimed is:

1. A locator for locating tubing ends, nipples, obstructions, joints or other narrowing or enlarging constrictions and/or operating as a centralizer comprising:

(a) a mandril;

(b) a variable indication means mounted with the mandril and contacting the inner bore of a pipe; and, (c) an urging means responsive to the indication means such that when the indication means is varied to cause such urging means to move wherein movement of such urging means is transmitted uphole to indicate the location of an enlarging or narrowing constriction unless such locator is operated as a centralizer wherein such urging means is not passed through a restriction but contacts the inner bore of the pipe to centralize objects connected below it or above it.

2. The locator of claim 1 wherein said variable indication means comprises a set of vertical longitudinally spaced bow springs extending radially and outward from said mandril, and slidably mounted on said mandril.

3. The locator of claim 1 wherein said urging means comprises an upper spring in sliding engagement with the upper end of said bow springs on said mandril.

4. The locator of claim wherein said urging means comprises a lower spring in sliding engagement with the lower end of said bow springs on said mandril.

5. The spring of claim 3 or 4 further comprising:

(a) a cylinder, the compressive stength of which may be varied by varying its radius, length, inside and outside diameters; and (b) a plurality of equidistantly spaced openings about the circumference of said cylinder, wherein said equidistantly spaced openings may be varied in distance therebetween, both horizontally and vertically, so as to vary the compressive strength of the spring.

6. A method of locating collars, nipples and obstructions comprising the steps of:

(a) lowering a variable indicating means within a mandril downhole in casing or tubing while reading a constant weight uphole as indicated by the urging means responsive to the variable indicating means; and, (b) detecting, from a change in resistance, the urging means contacting the variable indicating means whenever a collar, nipple, juncture or other obstruction comes into contact with said urging means.

7. A locator for locating tubing ends, nipples, obstructions, joints or other narrowing or enlarging constrictions and/or operating s a centralizer comprising:

(a) a mandril;

(b) a variable indication means having a set of vertical longitudinally spaced bow-springs slideably mounted on said mandril and extending radially outward from said mandril contacting the inner bore of a pipe for responsive indication to tubing ends, nipples, joints or other narrowing or enlarging constrictions and/or obstructions; and (c) an urging means responsive to said variable indication means and having an upper and lower spring for indication of movement of said variable indication means to the operator uphole thus, indicating the location of an enlarging or narrowing constriction unless the locator is operated as a centralizer, wherein such urging means is not passed through a restriction, but contacts the inner bore of the pipe to centralize objects connected below it or above it, and wherein said upper and lower springs comprise a cylinder and a plurality of equidistantly spaced openings about the circumference of said cylinder, wherein said equally spaced openings may be varied in distance therebetween, horizontally and vertically, in order to vary the compressive strength of the springs.

8. A locator for locating tubing ends, nipples, obstructions, joints or other narrowing or enlarging constrictions and/or operating as a centralizer comprising:

(a) a mandril;

(b) a variable indication means having a set of vertical longitudinally spaced bow-springs slideably mounted on said mandril and extending radially outward from said mandril contacting the inner bore of a pipe for responsive indication to tubing ends, nipples, joints or other narrowing or enlarging constrictions and/or obstructions; and (c) an urging means responsive to the indication means and comprising an upper and lower spring for indication of movement of said variable indication means to the operator uphole thus, indicating the location of an enlarging or narrowing constriction unless such locator is operated as a centralizer, wherein such urging means is not passed through a restriction but contacts the inner bore of the pipe to centralize objects connected below it or above it.

9. The upper and lower springs of claim 8 further comprising:

(a) a cylinder, the compressive strength of which may be varied by changing its radius, length, inside and outside diameters; and (b) a plurality of equidistantly spaced openings about the circumference of said cylinder, wherein said equidistantly spaced openings may be varied in distance therebetween, horizontally and vertically, so as to vary the compressive strength of the spring.

* * * * *